US005338218A

United States Patent [19]

Haas

[11] Patent Number: 5,338,218

[45] Date of Patent: Aug. 16, 1994

[54] ELECTRICAL APPLIANCE CURRENT SUPPLY CONTROL APPARATUS

[76] Inventor: Norman C. Haas, 2733 Puuhonua St., Honolulu, Hi. 96822

[21] Appl. No.: 31,842

[22] Filed: Mar. 16, 1993

[51] Int. Cl.[5] ..... H01R 13/44; H01R 13/713

[52] U.S. Cl. ..... 439/346; 200/43.02; 439/134; 439/263

[58] Field of Search ..... 439/133, 134, 304, 346, 439/263, 264; 200/43.02, 43.04, 43.05, 43.07, 43.08, 43.09, 43.11, 43.12

[56] References Cited

U.S. PATENT DOCUMENTS

| | | | |
|---|---|---|---|
| 3,691,327 | 9/1972 | Chesler | 200/42 |
| 3,833,779 | 9/1974 | Leone | 200/33 |
| 4,167,658 | 9/1979 | Sherman | 200/44 |
| 4,247,743 | 1/1981 | Hinton et al. | 200/44 |
| 4,969,833 | 11/1990 | Lindow et al. | 439/133 |
| 5,061,199 | 10/1991 | McClead | 439/304 |
| 5,070,219 | 12/1991 | Grosskrueger et al. | 200/43 |
| 5,071,360 | 12/1991 | Lindow et al. | 439/133 |
| 5,120,236 | 6/1992 | Gilbert | 439/133 |

*Primary Examiner*—Neil Abrams

*Attorney, Agent, or Firm*—Polster, Lieder, Woodruff & Lucchesi

[57] ABSTRACT

Electrical appliance current supply control apparatus in which there is positioned between an appliance plug with current pickup prongs and current input supply prongs a housing having electrical current carrying leads interconnecting the current input supply prongs and the current pickup prongs in which housing one of the electrical current carrying leads is led through a control in the housing which includes a key operated lock to either complete the current supply or to interrupt the current supply to the appliance pickup prongs through the one lead.

4 Claims, 3 Drawing Sheets

ELECTRICAL APPLIANCE CURRENT SUPPLY CONTROL APPARATUS

BACKGROUND OF THE INVENTION

1. Field of the Invention

The present invention is directed to electrical appliance current supply control apparatus for preventing unauthorized supply to an appliance upon operation of a key operated control.

2. Description of the Prior Art

It is known in the prior art that permanently attachable key-operated on/off switches have been provided for preventing the unauthorized operation of electrical appliances in which a locking pin is required to be inserted through the standard openings of the standard prongs of an electrical cord whereby the appliance standard plug is permanently attached to an on/off switch control. In such known instances a key switch is utilized in addition to a locking pin for controlling the current flow in the electrical power supply to the appliance. An example of such means is found in Lindow et al U.S. Pat. No. 4,969,833 of Nov. 13, 1990; Lindow et al U.S. Pat. No. 5,071,360 of Dec. 10, 1991; McClead U.S. Pat. No. 5,061,199 of Oct. 29, 1991; and Hinton et al U.S. Pat. No. 4,247,743 of Jan. 27, 1981.

It is also known in the prior art to combine a timer and electrical receptacle controller for television appliances, and to embody the components of such a system in a container that can be key locked in closed position to prevent the unauthorized operation of the timer. Such a system is found in Leone U.S. Pat. No. 3,833,779 of Sep. 3, 1974.

BRIEF DESCRIPTION OF THE INVENTION

It is an object of this invention to provide a simple key operated apparatus which can be selectively locked or unlocked, and when apparatus is locked to the standard prongs of an appliance current supply cord, the apparatus will effectively prevent current supply to the appliance thereby retaining the current flow disabled apparatus attached to the appliance so as to prevent moving the appliance to any other current supply receptacle.

It is a further object of the invention to provide key controlled apparatus that can utilize any one of several forms of key control mechanism for accomplishing the unauthorized operation of an appliance.

Other objects and important advantages related to the disclosed embodiments hereinafter to be described are intended to represent the scope of selectivity of equivalent apparatus.

BRIEF DESCRIPTION OF THE DRAWINGS

The preferred embodiments of the present invention are disclosed in the accompanying drawings herein.

DETAILED DESCRIPTION OF THE EMBODIMENTS

Figure 1:
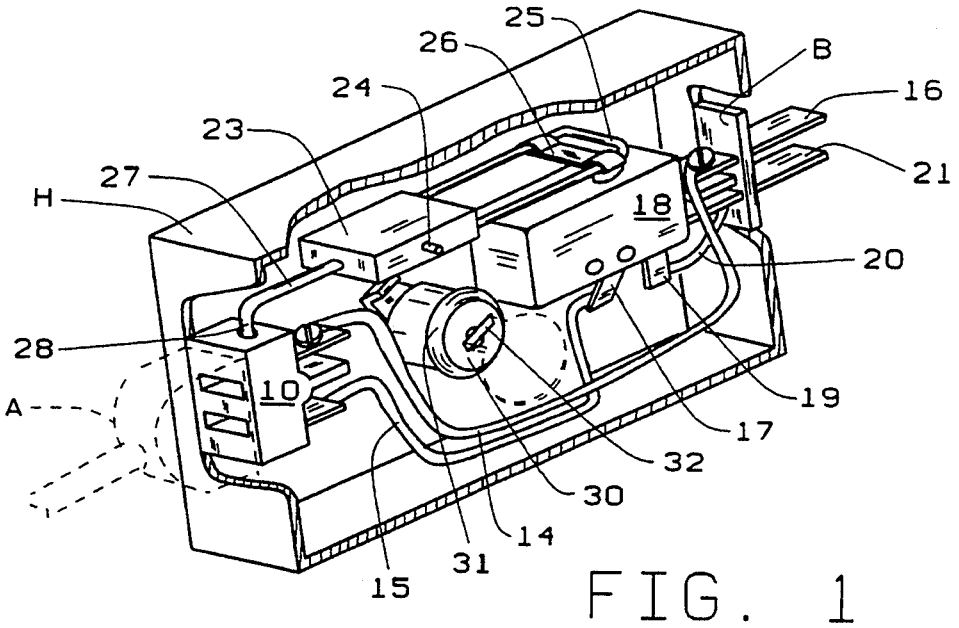
FIG. 1 is a fragmentary sectional perspective view of the housing showing a form of operated apparatus having a rocker control means for selectively pinning the apparatus to a phantom appliance current supply cord while disabling current supply.

In the perspective view of FIG. 1, with a housing H seen in fragmentary section, the current supply control apparatus includes an adapter receptacle 10 to present slots 11 to receive the contacts of an appliance plug seen in phantom at A. The receptacle 10 has current prongs 12 and 13 respectively extending from the receptacle 10 to receive connections of current leads 14 and 15. Lead 14 extends into connection with the base end of prong 16 mounted in the housing by a suitable insulator block B. The lead 15 extends into connection with a tap 17 of a switch 18, and switch 18 has a second tap 19 for a lead 20 which is connected to the base end of prong 21 supported by insulator block B. The switch 18 has a projection button 22 for operating a standard character of contacts (not shown) operatively mounted in that switch.

Figure 2:
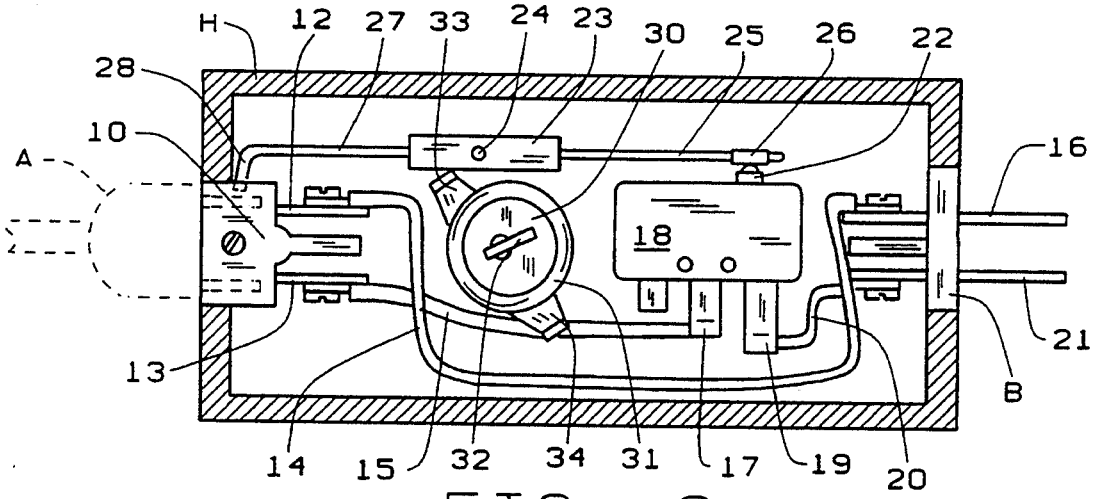
FIG. 2 is a view similar to FIG. 1 showing the key operating condition for permitting current supply to an appliance.
Figure 3:
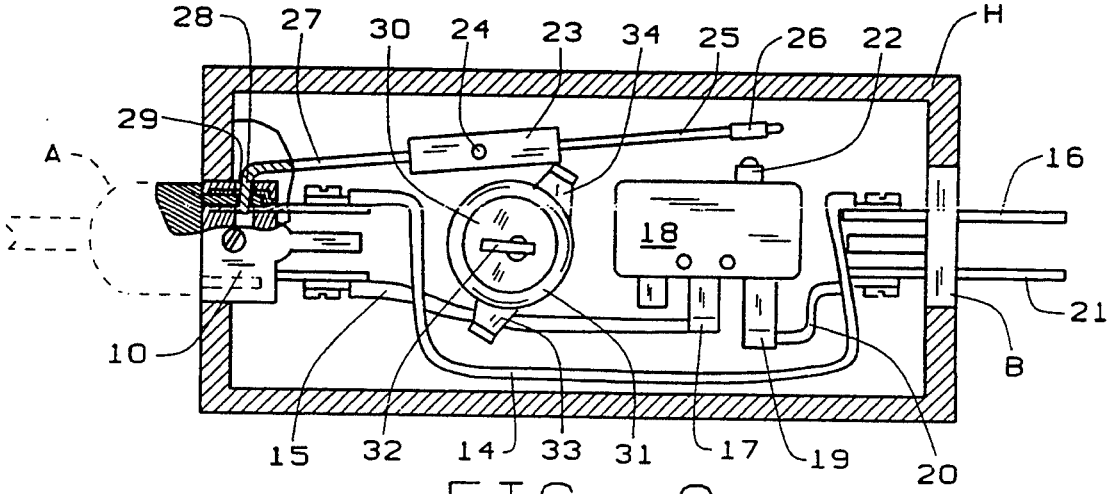
FIG. 3 is a view similar to FIG. 2 in which key operation has current flow interrupted to the appliance and the assembly is pinned to the appliance to prevent unauthorized use of the appliance.

The housing H of FIGS. 1–3 supports an insulator rocking block 23 having a pivot axle 24 mounted in the walls of that housing H. The block 23 supports an arm 25 which has a pressure pad 26 in position to operate the button 22 of the standard operating switch 18. Block 23 also supports an arm 27 having a bent tip 28 positioned to engage in an aperture 29 in the receptacle 10, as can be seen in the fragmentary sectional detail of FIG. 3. It is known that prongs of standard plugs on electrical cords have apertures therein. Thus, it is intended that the bent tip 28 on the arm 27 shall be formed so it enters the aperture 29 in the receptacle 10 and is able to engage in the standard aperture of one of the prongs of the appliance plug A. When the bent tip 28 enters a prong aperture the appliance plug A may not be withdrawn from housing H, and currently the arms 27 and 25 can be moved to operate switch button 22 to open the circuit. The movement of arms 27 and 25 can be seen in comparing FIGS. 2 and 3.

The important feature of the apparatus is seen in the mounting of a key operated lock 30 in the wall of the housing so the bezel 31 thereof appears in the front wall to expose a key receiving slot 32. In order to establish current supply to the apparatus prongs 16 and 21 are inserted in a wall receptacle. If the key operated tumbler 30 is rotated to swing a control arm 33 in a clockwise direction, that arm 33 will engage rocker block 23 and move the pad 26 to operate switch button 22 to close and supply current to lead 15. Current lead 14 is normally live so the result is that an appliance plug A is powered. When it is desired to interrupt current supply to an appliance, the key operated tumbler 30 is rotated in a counterclockwise direction to swing the opposite arm 34 on the tumbler 30 to rock block 23 to lift the pad 26 on arm 25 off switch block 22 and at the same time the pin 28 on arm 27 will enter the prong of plug A and lock that plug to the housing H. Normally the rocker block is weighted by arm 25 so it will seek to operate switch 18 and hold the bent tip 28 in unlocked position. Removal of the key will prevent the tumbler 30 from being rotated to operate switch button 22. Thus, key removal will establish a condition in which the appliance plug A Cannot be removed from the housing H and unauthorized use of an appliance is established. The pinning of the prong from plug A to housing H simultaneously opens the circuit between receptacle 10 and prongs 16 and 21 resulting in disabling the apparatus from being used regardless of trying to find a different current supply receptacle.

Figure 4:
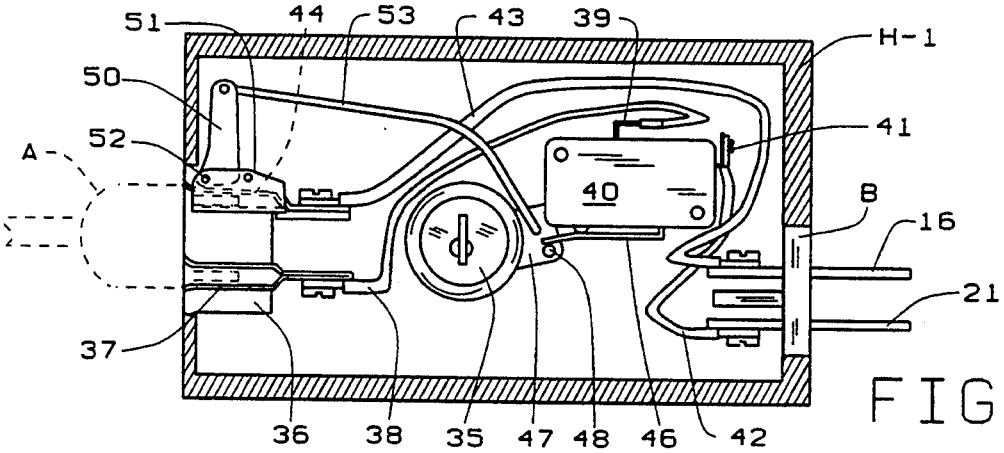
FIG. 4 is a further embodiment of apparatus having a pinching mechanism for key operation to allow current flow to an appliance.
Figure 5:
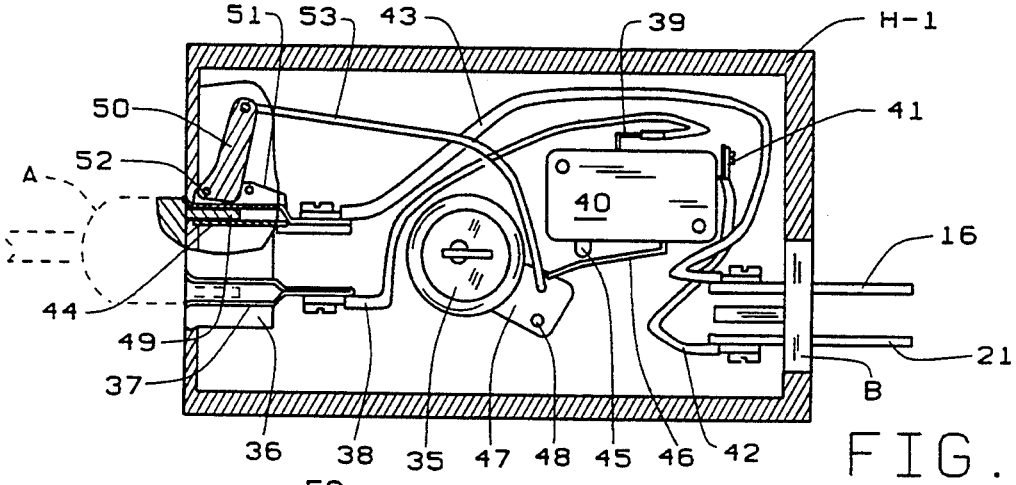
FIG. 5 is the embodiment of apparatus of key controlled character seen in FIG. 4 for interrupting current flow thereby disabling the operation of an appliance.

A further arrangement of apparatus is shown in FIGS. 4 and 5 in which the housing H-1 can be selectively locked or unlocked to the appliance plug A upon operation of the key operated lock 35. In this modified apparatus current input prongs 16 and 21 supported in block B are in circuit with a receptacle block 36 carried in position to receive the prongs of an appliance plug A. In this form of apparatus, the block 36 is provided with a slide contact 37 connected by lead 38 to the contact 39 on switch block 40. The switch block 40 has a second contact 41 connected by lead 42 to the base of prong 21. Similarly a slide contact 44 in block 36 is connected by lead 43 to the base of prong 16.

The apparatus of FIGS. 4 and 5 differs from the apparatus of FIGS. 1–3 in that the switch 40 has an operating button 45 positioned to be operated by a normally open lever arm 46. The means for actuating the lever arm 46 is carried on the lock 35 in the form of an arm 47 having an abuttment means 48 in position to engage the arm 46. A means for locking or unlocking the appliance plug A to the housing H-1 embodies the slide contact 44 which has a resilient contact to receive a prong 49 on plug A (see FIG. 5), and a pinch lever 50 pivoted in a suitable support 51 on the receptacle 36 by pin 52. The pinch lever 50 has an operating push-pull rod 53 interconnecting the outer end of the pinch lever 50 with the arm 47 on the lock 35. Key operation of the lock in a clockwise direction moves the lock arm 47 so the rod 53 pulls the pinch lever 50 to close the nose 50A thereof against the slide contact 44 on the prong 49 to squeeze contact 44 on that prong in a friction grip. At the same time that the pinch lever is operated to lock the appliance plug A to the housing H-1 the lever arm 46 is released from switch button 45 which interrupts the circuit through switch 40. Removal of a key from the lock 35 when the switch 40 is in circuit open position will effectively lock the housing H-1 to the appliance plug A to prevent unauthorized use of the appliance as before explained.

Figure 6:
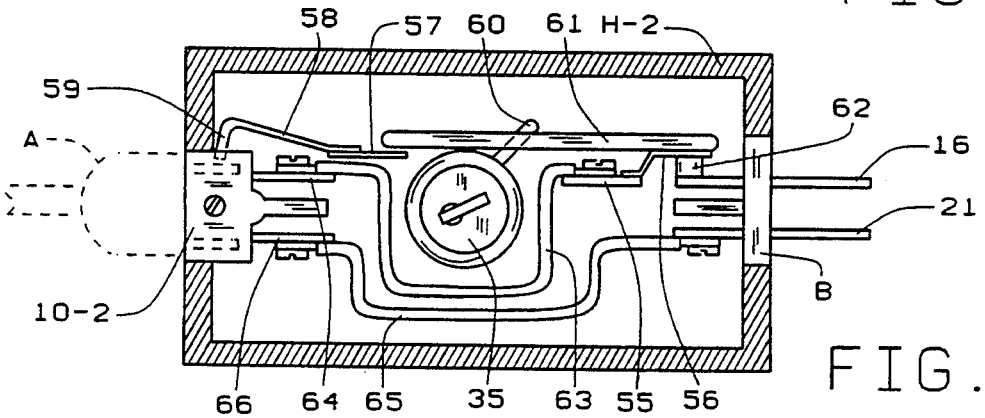
FIG. 6 is a fragmentary sectional view of key operated apparatus which is a variation of the apparatus seen in FIG. 2 for supplying current to an appliance.
Figure 7:
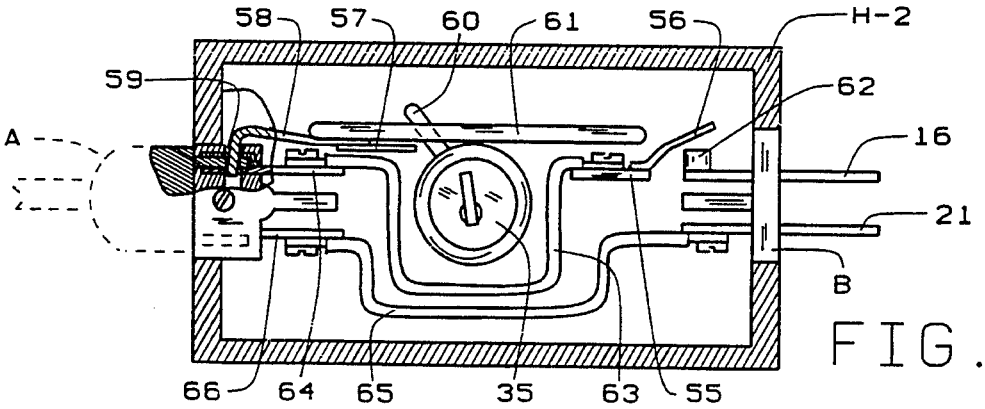
FIG. 7 is a view like FIG. 6 showing the apparatus pinned to an appliance with key operation to interrupt current flow.

The embodiment of apparatus seen in FIGS. 6 and 7 illustrates a further organization of apparatus for locking or unlocking the appliance plug A to a housing H-2. This embodiment employs an appliance receptacle 10-2 which essentially duplicates receptacle 10 of FIG. 2, but instead of having a standard switch body, like 18 in FIG. 2, there is a switch in the form of support 55 in the housing H-2 for spring responsive on/off contact 56. In addition, a further support 57 carries a locking pin 58 having a tip 59 which is employed to lock the plug A into the receptacle 10-2 as is shown in the fragmentary section view in FIG. 7. The operation of the key lock 35 affects movement of the arm 60 to shift the switch bar 61 from a first position, as in FIG. 6, to a second position, as in FIG. 7. FIG. 6 shows the bar 61 in position to close the circuit 63 on current supply contact 62 from the base of prong 16 through lead 63 to the contact 64 on the receptacle 10-2. The shift of switch bar 61 rightwardly by rotation of the key lock 35 closes contact 62 and releases the locking arm 58 so the pin 59 is by spring action retracted as the arm 58 springs up to withdraw the pin 59. Current is then enabled to pass to the appliance plug A because the lead 65 connects current input from prong 21 to the contact 66 on the receptacle 10-2. When a key rotates the lock 35 to shift bar 61 leftwardly by arm 60 the current supply contact 62 is opened and the arm 58 pushes the locking tip 59 into position to lock plug A to the housing H-2.

Figure 8:
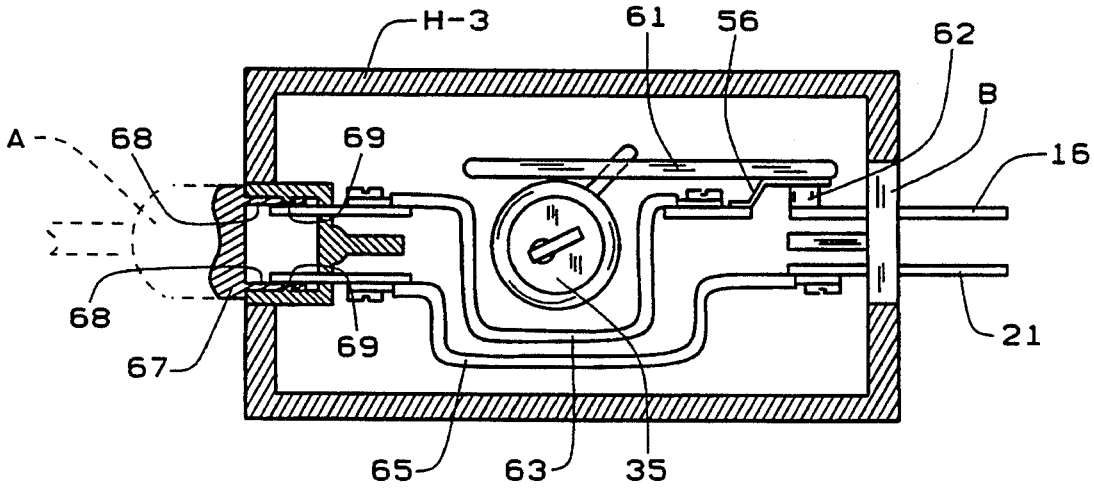
FIG. 8 is a fragmentary sectional view of a key operated apparatus which is a variation of the apparatus seen in FIG. 6.

In the apparatus seen in FIG. 8 a housing H-3 is provided with a receptacle 67 to receive the prongs 68 of the power cord on a plug A. The prongs 68 are formed with standard apertures of the well-known character, and the receptacle is provided with prong retainer element 69 of a one-way character which is slanted into position to allow the prongs 68 to move past the retainer elements 69 to the position that allows the elements 69 to enter the standard prong apertures thereby making it impossible to withdraw the plug A from the housing H-3. However, housing H-3 is provided with the block B having power input prongs 16 and 21 (see FIGS. 6 or 7) to adapt for connection into a wall power receptacle for current supply. When the power to plug A is to be cut off, the key operated lock 35 is turned to move the switch bar 61 to the left to allow the spring contact to open contact 62 thereby cutting off current to lead 64. Lead 65 is not affected, but there is no current supplied to the plug A. Removal of the key will prevent power supply to the appliance associated with plug A.

Figure 9:
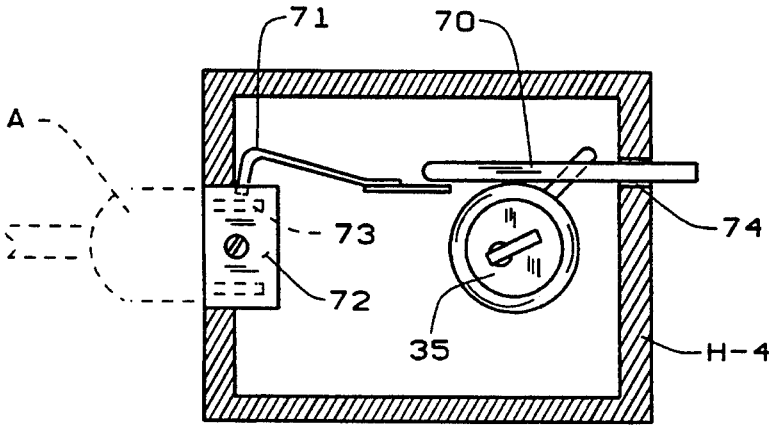
FIG. 9 is a fragmentary sectional view of a key operated apparatus for disabling an appliance power cord.
Figure 10:
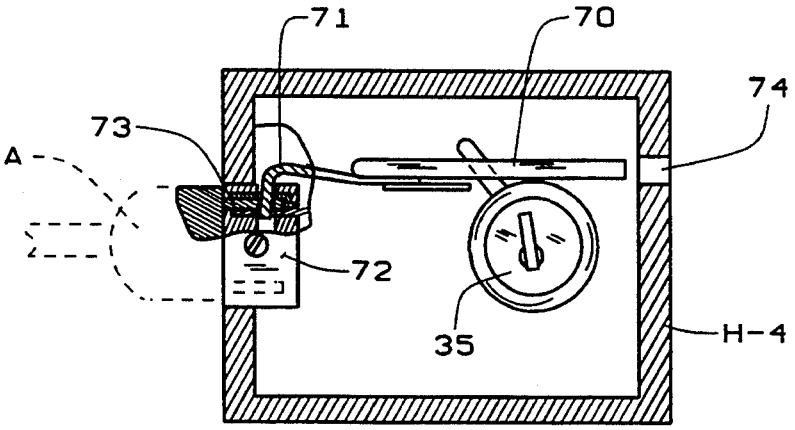
FIG. 10 is a fragmentary sectional view of the apparatus of FIG. 9 in which the appliance cord is disabled upon key operation.

Turning now to FIGS. 9 and 10, there is shown a simple variation of means for disabling use of the appliance A in the form of a lock-out housing H-4 that is operable to allow the appliance plug A as in FIG. 9 to be withdrawn so it can be plugged directly into a power outlet receptacle. Removal of the housing H-4 from the plug A is accomplished by turning the key operated lock 35 to-shift bar memeber 70 so it allows the spring hook 71 to lift out of receptacle 72. When the hook 71 is allowed to lift it disconnects from the aperture of a standard prong 73 which has the usual aperture.

If it is intended to prevent use of the appliance plug A, as in FIG. 10, the key operated lock 35 is rotated to shift the bar 70 in the direction to press the hook 71 into the receptacle 72 so prong 73 of plug A is retained to prevent the housing H-4 to be removed from plug A. It is seen in FIGS. 9 and 10 that the housing H-4 is formed with an aperture 74 that allows the shift bar member 70 to project into view, as in FIG. 9, to indicate that housing H-4 is free to be removed. When the aperture is empty the housing H-4 is indicated to be attached to prong 73.

The foregoing details of construction of electrical appliance current supply control apparatus embodies a key operated control to make or interrupt current supply to any appliance, whether it is a television or some other item of equipment that may require a key control to regulate the use thereof. The apparatus of this invention is easily adaptable to many different embodiments having a common arrangement of key controlled circuit make and break provisions that use many standard electrical components which cooperate with a rotary key body to achieve the result described.

What is claimed is:

1. Electrical appliance current supply control apparatus for use with an appliance having a current supply cord with standard electrical current receiving plug prongs having standard sized apertures in the plug prongs, said control apparatus comprising:

a) a housing:

b) an electrical receptacle in said housing formed with prong slots to receive said appliance cord mounted plug formed with standard prongs;

c) an electrical current input fixture in said housing to mate with a current source;

d) controllable means in said housing adapted to be moved selectively to lock and unlock said appliance electrical supply cord standard prongs in said electrical receptacle in said housing;

e) electrical current carrying connections between said current receiving prongs and said prong slots for said appliance electrical supply prongs, said current carrying connections including an on/off switch; and f) key operated control means in said housing operative to selectively lock said appliance electrical supply cord prongs to said housing concurrently with operation of said on/off switch to said current off position or to unlock said appliance electrical supply cord prongs concurrently with operation of said switch to current on position.

2. The apparatus set forth in claim 1 wherein said controllable means is a rocker means operatively mounted in said housing to be responsive to said control means and said on/off switch.

3. The apparatus set forth in claim 1 wherein said controllable means includes a bar member movable in a substantially linear path in said housing to be responsive to said control means and said on/off switch.

4. In electrical appliance current control apparatus for disabling use of appliance plugs having prongs comprising in combination:

a) a housing having a receptacle presented to receive the prongs of an appliance plug;

b) a prong engaging spring retainer normally in raised out of prong engagement position;

c) a shift bar movable in said housing and supported in an aperture in said housing open to the exterior to be in view; and d) key operated lock means having an operative connection with said shift bar for moving said bar in a first direction upon locking operation of said locking means to close said spring retainer upon one of said prongs to retain the appliance plug attached to said housing, said key operated lock being operative to move said bar to a second position to be at least partly in view outside said housing concurrently with said spring retainer returning to its normally raised out of prong engagement position.

* * * * *